US006758652B2

(12) United States Patent
Torre et al.

(10) Patent No.: US 6,758,652 B2
(45) Date of Patent: Jul. 6, 2004

(54) APPARATUS FOR CHOKING THE CONTROL STAGE OF A STEAM TURBINE AND STEAM TURBINE

(75) Inventors: Alberto Torre, Genoa (IT); Loris Falavigna, Genoa (IT)

(73) Assignee: Ansaldo Energia S.p.A., Genoa (IT)

( * ) Notice: Subject to any disclaimer, the term of this patent is extended or adjusted under 35 U.S.C. 154(b) by 49 days.

(21) Appl. No.: 10/184,839

(22) Filed: Jun. 28, 2002

(65) Prior Publication Data

US 2003/0002980 A1 Jan. 2, 2003

(30) Foreign Application Priority Data

Jul. 2, 2001 (EP) ..... 01830443

(51) Int. Cl.[7] ..... F01D 17/14
(52) U.S. Cl. ..... 415/150; 415/155; 415/159
(58) Field of Search ..... 415/150, 151, 415/155, 159, 202

(56) References Cited

U.S. PATENT DOCUMENTS 5,383,763 A * 1/1995 Henkelmann ..... 415/159
6,402,465 B1 * 6/2002 Maier ..... 415/159

FOREIGN PATENT DOCUMENTS

| | | |
|---|---|---|
| DE | 1551224 | 2/1970 |
| DE | 1914438 | 4/1970 |
| DE | 1934171 | 9/1970 |
| DE | 1915450 | 10/1970 |
| EP | 0493627 | 7/1992 |

* cited by examiner

*Primary Examiner*—Edward K. Look
*Assistant Examiner*—Dwayne J. White
(74) *Attorney, Agent, or Firm*—McAndrews, Held & Malloy, Ltd.

(57) ABSTRACT

A turbine, intended to be used in a plant of the geothermal type, comprises an apparatus for the choking of the control stage. The latter provides closure means for closing at least one nozzle of the first stage of the turbine, the said nozzles facing a final section of a feed pipe of the said turbine. Also provided are control means for controlling the said closure means, capable of causing the said closure means to assume at least one position of rest and one working position in which they are disposed to close the at least one nozzle in the vicinity of the final section of the said feed pipe.

15 Claims, 5 Drawing Sheets

APPARATUS FOR CHOKING THE CONTROL STAGE OF A STEAM TURBINE AND STEAM TURBINE

FIELD OF THE INVENTION

A subject of the present invention is an apparatus for choking the control stage of a steam turbine.

According to a further aspect, a subject of the present invention is a steam turbine, especially for geothermal applications.

BACKGROUND OF THE INVENTION

As is known, geothermal power stations exploit the endogenous heat of the earth to produce the steam that will directly or indirectly feed the steam turbine.

In particular, various cycles may be adopted for using the abovementioned steam, which cycles in the present case may be summarized as follows: turbines fed with indirect steam produced by means of heat exchangers, turbines fed with steam originating directly from the geothermal well, and finally turbines fed with what is known as "flashed" steam, meaning turbines in which the steam originating from the well is introduced into a water tank from which the steam for feeding the turbine is taken.

In more detail, the present invention relates to cycles of the second type or turbines fed with steam originating directly from the geothermal well. In such cases, the geothermal well is fed with water to achieve the necessary production of steam, a balance always being preserved between the conflicting requirements of feeding the turbines and "cultivating" the geothermal well. In such conditions, it is clear that the production of steam from the subsoil does not guarantee a flow rate and a pressure that are constant over time. Specifically, if the flow rate is kept constant, for example, the pressure may vary substantially in the course of a few months, with the consequence that on any change in pressure the sections of the steam inlet into the nozzles of the turbine would also have to be changed.

For the purposes of sizing the inlet sections appropriately, therefore, the pressure and flow-rate conditions of the steam entering the turbine can only be estimated and it will subsequently be necessary to adapt the abovementioned inlet sections in order to obtain the optimum performance.

In addition to the abovementioned variations in flow rate and/or pressure inherent in the steam generation system itself, the use of direct steam also influences the said values, thus introducing a further degree of uncertainty into the data for designing the inlet sections of the turbine.

The steam originating directly from the geothermal well contains impurities, such as for example sulphur compounds or silicates, which may create scaling that forms on the inside walls of the turbine and/or cause wear and erosion of the steam passage sections. This phenomenon changes the internal geometry of the turbine and consequently the pressure and flow-rate values.

It is thus clear that, in order to be able to adapt the inlet sections of the turbine to the requirements resulting from the variability of the inlet flow rate and/or pressure, there is a very evident need to change the number of nozzles of the first stage through which the steam passes, increasing it when the pressure falls and vice versa.

For this purpose, it is known to shut down the turbine, gain access to the inner space and directly modify the inlet section of the nozzles, blocking off the necessary number.

However, it is clear that such a solution suffers from numerous disadvantages, primarily unacceptable machine shutdowns due not only to the time required for the work of blocking off the nozzles but also to the time necessary for cooling and restarting the turbine.

It is also known to make such an adjustment in a different manner that makes it possible to operate during the functioning of the turbine and hence to eliminate the abovementioned disadvantages. This arrangement provides for the use of valves fitted to the intake pipe admitting the steam into the turbine.

This solution also is not free from disadvantages, owing to the fact that the valves have to be fitted to individual pipes that feed groups of nozzles. In this case, specifically, the production of the pipes is complex and costly, and has an adverse effect on the optimum geometry of the intake pipe, inevitably causing additional losses.

The problem on which the present invention is based is therefore that of proposing an apparatus for the choking of the control stage of a steam turbine, and a steam turbine that possesses structural and functional characteristics such as to satisfy the abovementioned requirements and, at the same time, to overcome the disadvantages cited with reference to the known art.

SUMMARY OF THE INVENTION

This object is achieved by means of an apparatus for the choking of the control stage of a steam turbine and a steam turbine in accordance with, respectively, claim 1 and claim 17.

BRIEF DESCRIPTION OF THE DRAWINGS

Further features and advantages of the apparatus and turbine according to the invention will be apparent from the description given below of a preferred example of embodiment thereof, given by way of indication and not implying any limitation, with reference to the attached figures, in which.

DETAILED DESCRIPTION OF THE INVENTION

With reference to the abovementioned figures, the reference 10 has been used to designate a steam turbine, in particular for geothermal applications, which in its more general structure possesses technical features that are substantially known in the industry and, as such, will be mentioned only briefly.

Figure 1:
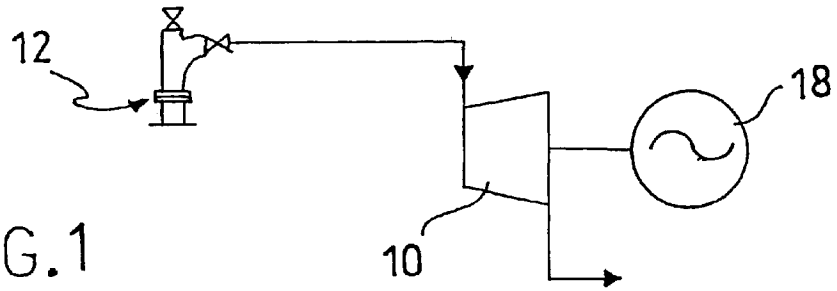
FIG. 1 shows a functional diagram of a geothermal plant comprising a turbine according to the present invention.

FIG. 1 shows diagrammatically the plant into which the turbine 10 is fitted, corresponding to what is known as a direct steam cycle. The reference 12 has been used to designate a geothermal well fed in a manner such as to obtain steam that is passed directly to the turbine 10.

The latter is conventionally formed by a rotor, or impeller, 14, mounted in a shell 16 and associated with a generator, designated 18 in FIG. 1.

The reference 20 has been used to designate a steam inlet section from which a feed pipe 22 of the said turbine runs. Having passed through the latter, the flow of steam passes through a final section 24 of the said pipe, structured in the form of a circular ring coaxial with the rotor.

The feed pipe 22, which extends from the abovementioned inlet section 20 to the abovementioned final section 24, defines the internal geometry of the turbine in the steam inlet zone.

Facing this final section 24 are nozzles 26 defining a first stage for action of the turbine. This final section 24 thus represents the feed section for feeding the abovementioned nozzles 26.

The impeller 14 extends conventionally in the radial direction in rings of blades, of which the blades of the first stage of the turbine have been designated by the reference 28.

An apparatus for the choking of the control stage of the said turbine, designated as a whole by the reference 30, is advantageously provided in alignment with the nozzles 26 of the first stage.

Figure 4:
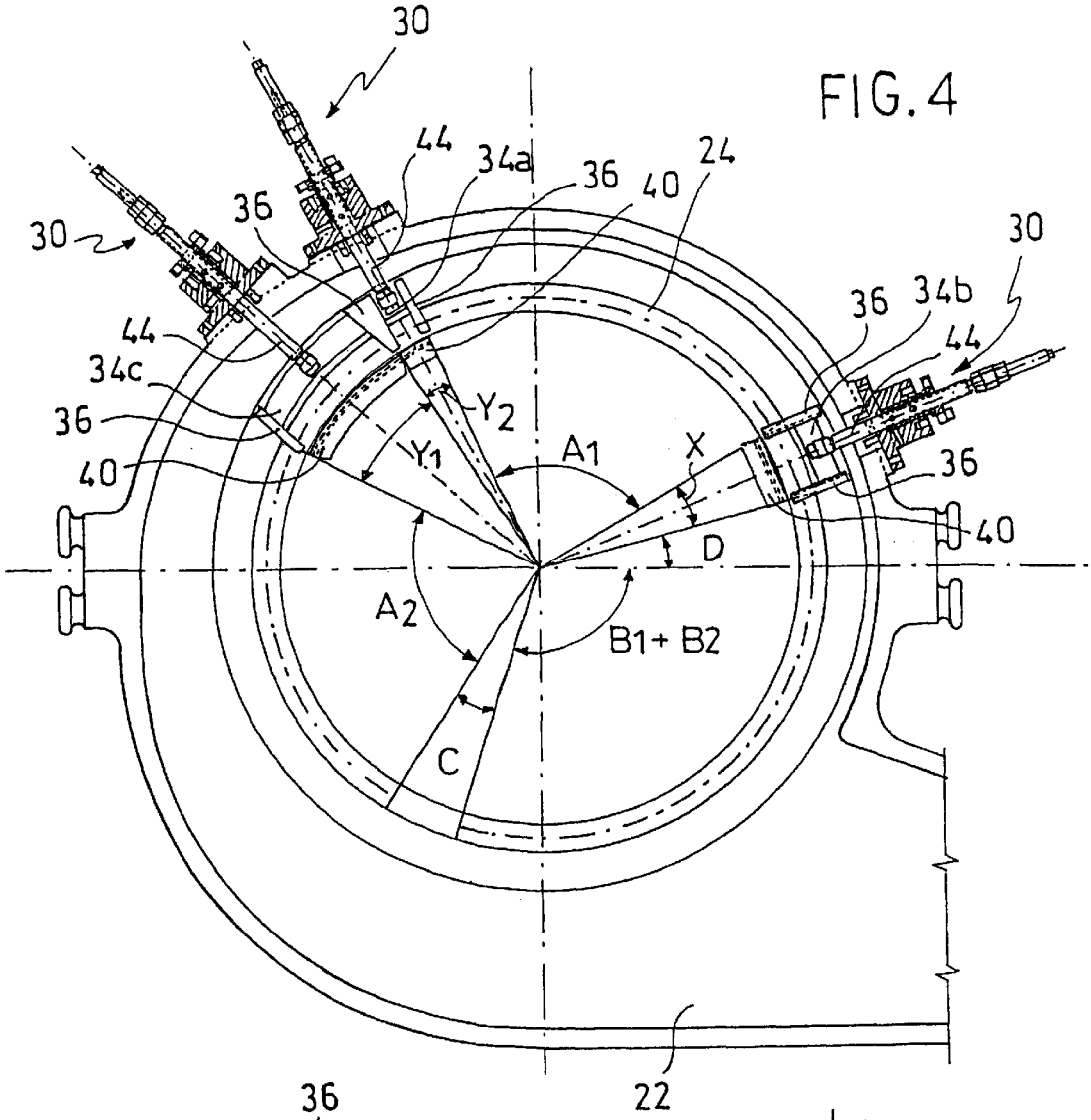
FIG. 4 shows a further section of the inlet zone of the turbine, taken in a plane transverse to the longitudinal development of the said turbine.
Figure 6:
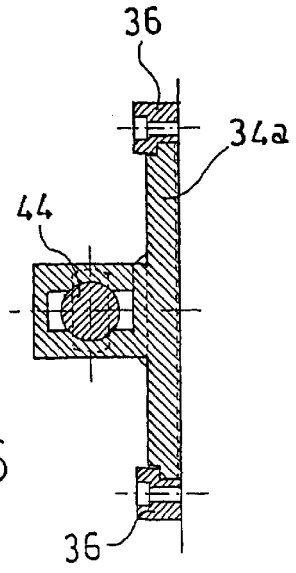
FIG. 6 shows a section of a detail from FIG. 5, along the line VI—VI.
Figure 7:
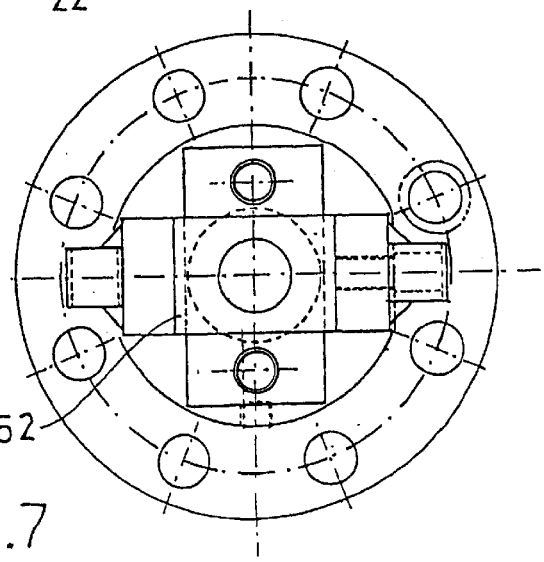
FIG. 7 shows a view from above of the detail shown in FIG. 5.

This apparatus comprises closure means 32 for closing at least one of the nozzles of the first stage of the turbine, an example of embodiment of which is shown in FIG. 4.

Specifically, this figure shows a transverse section through the turbine taken at the level of the feed pipe and in which three mobile walls 34*a*, 34*b* and 34*c* are shown, forming part of the abovementioned closure means.

In the plan shown in FIG. 4, the said walls are configured in the form of a sector of a circular ring which extends through an angular sector equal to the angular extension of a predetermined number of nozzles 26. It is particularly advantageous to provide, as in the example shown, a first wall 34*a* which extends through an angular sector Y2 equal to the angular extension of two nozzles 26, a second wall 34*b* which extends through an angular sector X equal to the angular extension of four nozzles 26 and finally a third wall 34*c* which extends through an angular sector Y1 equal to the angular extension of eight nozzles 26. The abovementioned individual sectors of nozzles are defined by delimitation elements 36, in the form of small columns or sectors disposed radially relative to the final section 24 of the feed pipe. These small columns further define a sliding track for the abovementioned walls 34*a*, 34*b* and 34*c*.

The presence of the said sectors Y1, Y2 and X of varying extent makes it possible to obtain optimum adaptation of the possibilities of adjustment, as will be shown below.

As regards the distribution of the three abovementioned sectors Y1, Y2 and X, the latter may be contiguous or otherwise, as in the case shown. This distribution depends, for example, on the presence of sectors or arcs of larger nozzles choked inside the turbine, as for example the sector designated A1. In the example shown, this sector A1 is equal to a sector corresponding to twenty-two nozzles 26.

Along the extension of the circular ring corresponding to the nozzles 26 of the first stage, then, are defined arcs or angular sectors of nozzles, on which action can be taken in different ways in order to obtain a choking that permits the better adaptation of the geometry of the turbine to the steam pressure and flow-rate conditions.

Figure 3:
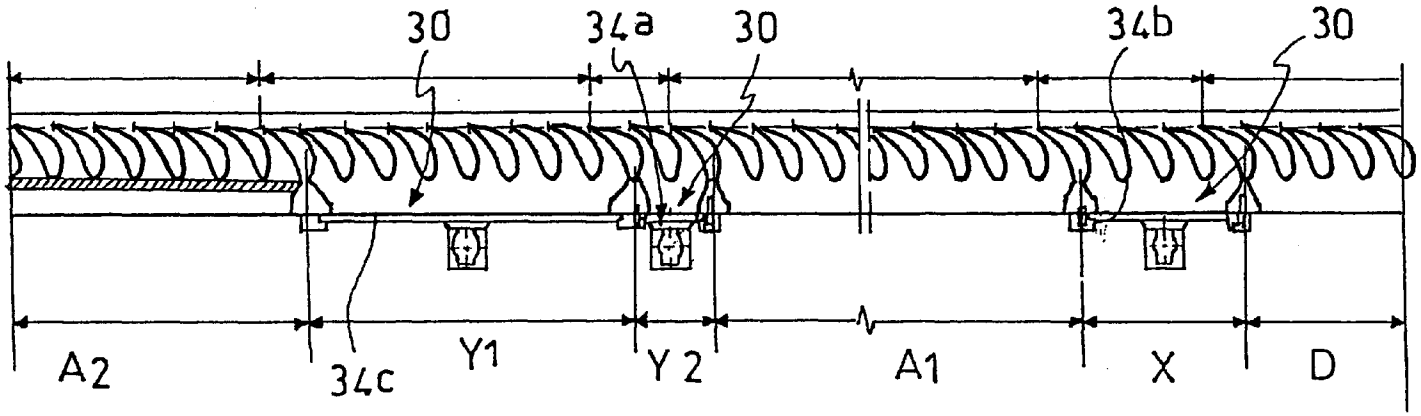
FIG. 3 shows a linear development of a detail from FIG. 2.
Figure 3:
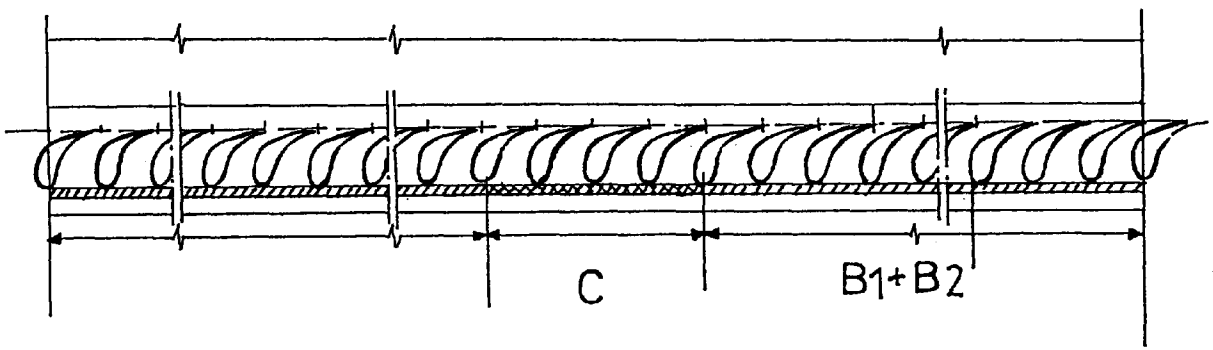
Figure 2:
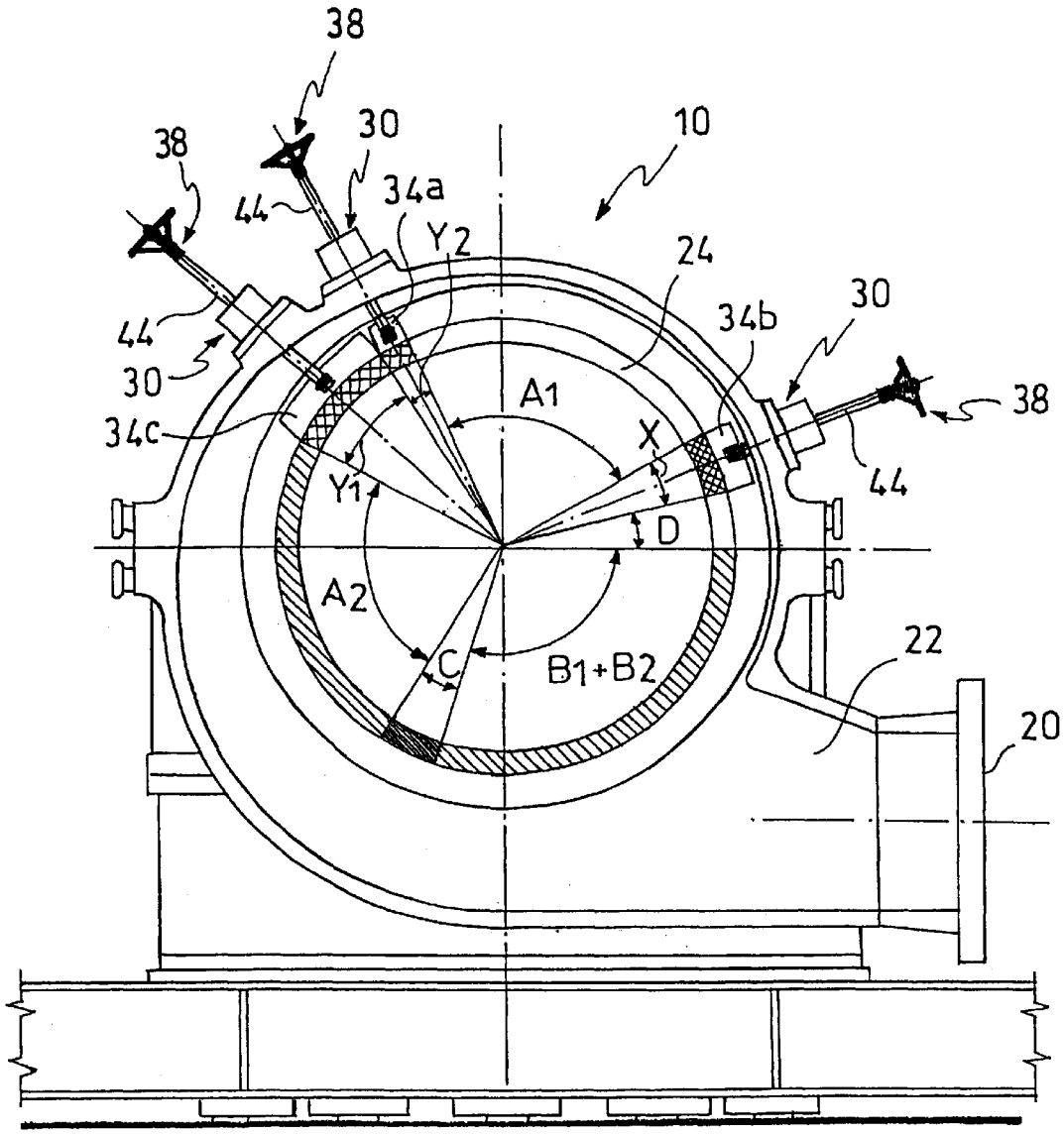
FIG. 2 shows a section of the inlet zone of the turbine, taken in a plane transverse to the longitudinal development of the said turbine.

Specifically, FIG. 3 shows a linear development of the nozzles 26 and of their subdivision into sectors defined not only by the references given above (X, Y1, Y2, A1) but also by the further references A2, B1, B2. The upper portion of FIG. 3 shows the development of the upper half of the nozzles 26, while the lower portion shows the development of the lower half of the nozzles 26. In the subdivision between lower half and upper half, the arc A2 is shown partly in the upper half and partly in the lower half.

The arcs or sectors A1, A2, B1 and B2 represent an equivalent number of steam intake sectors which, when the machine is shut down, can be closed by means of closure elements fixed and predetermined as a function of the intended configuration, or of the pressure estimated at the intake. In the example shown, the arc A2 corresponds to a sector equal to twenty-two nozzles 26, while the arc corresponding to the sum of the arc B1 and the arc B2 is equal to twenty-eight nozzles 26.

The arcs or sectors X, Y1 and Y2, by contrast, represent an equivalent number of steam intake sectors which can be closed or opened as a function of the position assumed by the abovementioned mobile walls 34*a*, 34*b* and 34*c* actuated by control means 38 during the functioning of the machine. The progressive and combined closure of the abovementioned walls 34*a*, 34*b* and 34*c* covers a broad range of possibilities that extends from a minimum value of two nozzles to a maximum value of fourteen nozzles, obtained when all the walls 34*a*, 34*b* and 34*c* are closed.

In the example shown, the sector named A1 is always open and the opening, in order, of the sectors Y2, Y1, X makes it possible to maintain a continuous intake arc.

Also present in the example shown are a sector C, corresponding to an arc of four closed nozzles, and a sector D of approximately 15°, interposed between the arc X and the arc B1+B2 and corresponding to an arc of four nozzles 26.

The abovementioned control means 38 are structured in a manner such as to cause the closure means 32, and in particular the walls 34*a*, 34*b* and 34*c*, to assume at least one position of rest and one working position.

In the position of rest, the walls 34*a*, 34*b* and 34*c* are positioned in a circular ring further out than that corresponding to the nozzles 26 and do not interfere with the flow of steam within the feed pipe or influence the optimum geometry of the latter (FIG. 4).

In the working position, the walls are disposed to close the respective sector of nozzles in the vicinity of the final section 24 of the feed pipe 22. In this position, each of the walls 34*a*, 34*b* and 34*c* is delimited by a stop 40, or lower guide, disposed tangentially relative to the final section 24 of the feed pipe 22, and is also in contact with the delimitation elements 36 of the inlet section of the respective sector of nozzles. Each of the walls 34*a*, 34*b* and 34*c* thus comprises a closure surface 42 which is positioned behind the final section 24 of the feed pipe 22 and corresponding to the inlet section of the corresponding sector of nozzles 26.

The abovementioned walls 34*a*, 34*b* and 34*c* thus define, in the working position, a break in continuity interposed between the feed pipe and the corresponding nozzles. This break in continuity is directly facing the inlet section of the corresponding sector of nozzles.

The control means 38 are structured in a manner such as to cause each of the walls 34*a*, 34*b* and 34*c* to translate in a direction of displacement parallel to the closure surface 42 of the said wall. In the example shown in FIG. 4, each direction of displacement corresponds to a radial direction relative to the final section 24 of the feed pipe 22.

Figure 5:
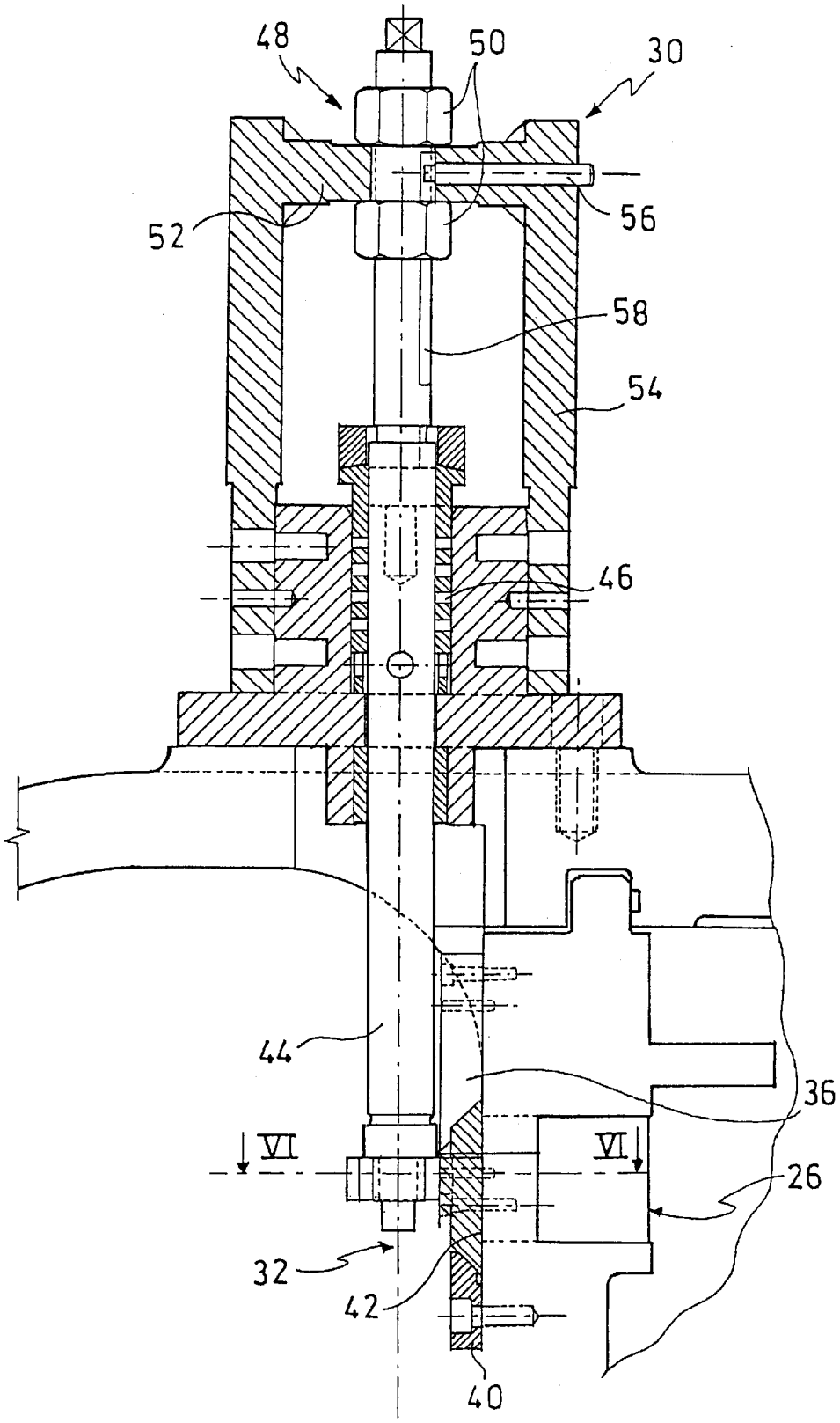
FIG. 5 shows a detail from FIG. 4.
Figure 8:
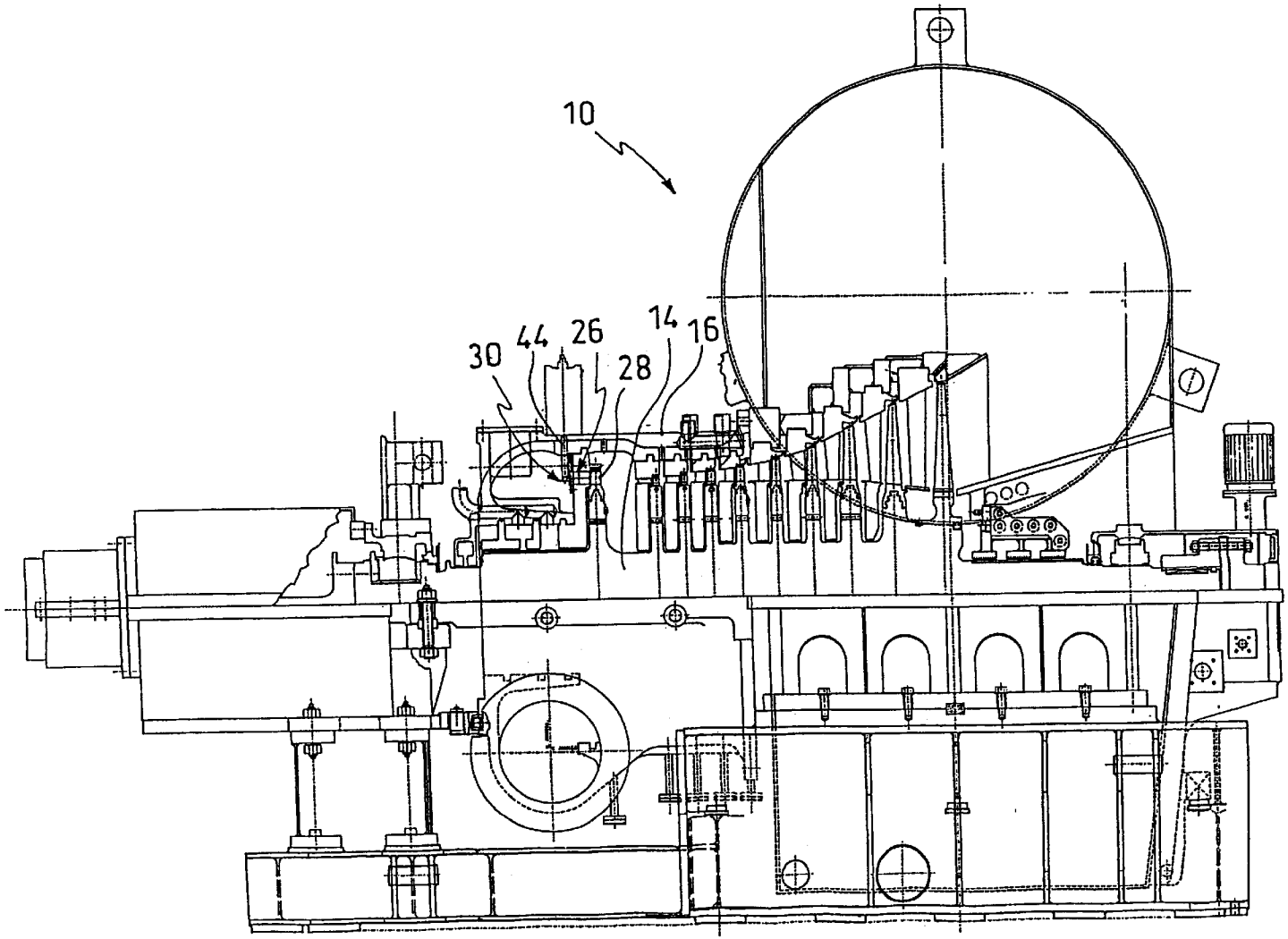
FIG. 8 shows a partial section of a detail of the turbine, taken in a plane longitudinal relative to the said turbine.

As shown in FIG. 5, the control means 38 comprise, for each of the walls 34*a*, 34*b* and 34*c*, a connecting element 44 operationally associated with the closure means 32 and provided with an end that extends outside the turbine. This connecting element is produced in the form of a rod having one end solidly fixed to the corresponding wall, movable along its own axis and provided with seals 46 produced in the form of rings. This connecting element 44 may be associated with a manual wheel outside the turbine, in a manner such as to be capable of actuation during the functioning of the machine.

The wheel control system is removable in that blocking means 48 are also provided to retain the closure means 32 in the working position. These blocking means comprise a nut/counternut system 50 screwed onto the rod 44 to span a plate 52 defining the base of a frame 54 inserted coaxially with the rod 44.

A locking pin 56 is inserted into a channel 58 of the rod 44 to prevent the latter from rotating about its axis.

A description is given below of the method of use of the closure means described above and of the control means described above.

As a function of the pressure/flow-rate value desire at the inlet of the turbine, the number of nozzles through which the passage of steam is allowed is adjusted. In particular, in order to reduce the pressure (and increase the flow rate) the nozzles of a particular sector are opened progressively, causing the corresponding wall to translate from the working position into the position of rest. In FIG. 4, all the walls 34*a*, 34*b* and 34*c* are shown, for example, in the position of rest.

For this purpose, the wheel control is actuated, causing the available sectors to open in sequence in order to achieve a high degree of precision and graduation.

Conversely, in order to increase the pressure (and reduce the flow rate) the wheel control is actuated causing the respective wall to translate from the position of rest into the working position. For example, FIG. 5 shows one of the walls 34*a*, 34*b* and 34*c* disposed in the working position, with the corresponding nozzles 26 closed.

This position is ensured by the blocking means 48. In particular, the frame 54 is inserted and the nut/counternut system 50 is secured. The insertion of the locking pin 56 prevents the rod 44 from rotating.

From the above, it will be appreciated that the provision of movable walls which, in the working position, act directly to close the final section of the feed pipe makes it possible to meet the abovementioned requirements. In particular, the advantageous configuration of a choking apparatus according to the present invention makes it possible to eliminate the unacceptable machine shutdowns necessary to install and remove fixed closures, making it possible to operate from outside the turbine when the latter is in operation.

Furthermore, this configuration makes it possible to maintain the optimum geometry of the feed pipe unaltered, avoiding structural complications and hence keeping both size and costs within limits.

It is clear that alternative embodiments and/or additions are possible to what has been described above and illustrated.

As an alternative, and as shown in the figures, the number, shape, dimensions or configurations of the walls provided may be different, for example depending on contiguous nozzle sectors.

The control means may also be different, for example providing directions of displacement of the walls that may be either linear, as provided in the example shown, or curved.

To replace the manual wheel, alternative embodiments may be provided, comprising, for example, an electrical, pneumatic or hydraulic actuator. These systems permit the remote or automatic manoeuvring of the choking apparatus according to the present invention.

On the basis of the preferred form of embodiment of the apparatus and turbine described above, a person skilled in the art, in order to meet contingent and specific requirements, may make numerous modifications, adjustments or replacements of elements with others that are functionally equivalent, without thereby departing from the scope of the claims that follow.

What is claimed is:

1. An apparatus for choking the control stage of a steam turbine, the apparatus comprising:

a closure mechanism capable of closing at least one nozzle of a turbine, said at least one nozzle facing a final section of a feed pipe of said turbine, and a control mechanism capable of controlling said closure mechanism, said control mechanism capable of causing said closure mechanism to assume a rest position and a working position, said closure mechanism configured to close at least one nozzle in the vicinity of the final section of said feed pipe, wherein the closure mechanism comprises at least one wall movable between said rest position and said working position, wherein said wall is in contact with delimitation elements delimiting the inlet section of said at least one nozzle, and wherein said at least one wall defines a closure surface parallel to the direction of displacement of said wall from said rest position to said working position.

2. The apparatus of claim 1, wherein said closure mechanism defines, in said rest position, a break in continuity interposed between said feed pipe and said at least one nozzle, and directly facing an inlet section of said at least one nozzle.

3. The apparatus of claim 1, wherein said at least one wall translates from said rest position to said working position in a radial direction relative to said final section of said feed pipe.

4. The apparatus of claim 1, wherein said closure mechanism comprises a first wall which, in said working position, closes two nozzles in the vicinity of the final section of said feed pipe.

5. The apparatus of claim 1, wherein said closure mechanism comprises a second wall which, in said working position, closes four nozzles in the vicinity of the final section of said feed pipe.

6. Apparatus according to claim 1, wherein said closure mechanism comprises a third wall which, in said working position, closes eight nozzles in the vicinity of the final section of the said feed pipe.

7. A steam turbine comprising the choking apparatus of claim 1.

8. The apparatus of claim 1, wherein said delimitation elements comprise sectors disposed radially relative to the final section of said feed pipe.

9. The apparatus of claim 8, wherein said delimitation elements comprise stops disposed tangentially relative to the final section of said feed pipe.

10. The apparatus of claim 1, wherein said control mechanism comprises at least one connecting element operationally associated with said closure mechanism and provided with an end that extends outside the turbine.

11. The apparatus of claim 10, wherein said at least one connecting element is a rod having an end solidly fixed to said at least one wall and movable along its own axis.

12. The apparatus of claim 11, wherein said rod is operatively associated with a removable wheel control actuateable to control the displacement of said at least one wall from said rest position to said working position and and from said working position to said rest position.

13. The apparatus of claim 10, further comprising a blocking mechanism for retaining said closure mechanism in said working position.

14. The apparatus of claim 13, wherein said blocking mechanism comprises a nut/counternut system.

15. The apparatus of claim 13, wherein said blocking mechanism comprises at least one locking pin insertable into a channel of said connecting element.

* * * * *